US006846162B2

(12) United States Patent
Chou

(10) Patent No.: US 6,846,162 B2
(45) Date of Patent: Jan. 25, 2005

(54) CYLINDER HOUSING FOR AIR COMPRESSOR

(76) Inventor: Wen San Chou, No. 1-25, Kang Wei Village, An Din Hsiang, Tainan Hsien (TW), 745

( * ) Notice: Subject to any disclaimer, the term of this patent is extended or adjusted under 35 U.S.C. 154(b) by 11 days.

(21) Appl. No.: 10/216,590

(22) Filed: Aug. 12, 2002

(65) Prior Publication Data

US 2004/0028533 A1 Feb. 12, 2004

(51) Int. Cl.[7] ..... F04B 49/00
(52) U.S. Cl. ..... 417/63; 417/307; 417/440
(58) Field of Search ..... 417/63, 307, 415, 417/440, 454, 569; 415/182.1, 213.1, 214.1, 215.1

(56) References Cited

U.S. PATENT DOCUMENTS 5,154,589 A * 10/1992 Ruhl et al. ..... 417/446
5,174,343 A * 12/1992 Rood ..... 141/18
6,056,007 A * 5/2000 Gochenouer et al. ..... 137/351
6,059,542 A * 5/2000 Chou ..... 417/360
6,123,515 A * 9/2000 Santoro, Jr. et al. ..... 417/243
6,129,516 A * 10/2000 Wang ..... 417/36
6,146,112 A * 11/2000 Chou ..... 417/360
6,200,110 B1 3/2001 Chou ..... 417/415
6,213,725 B1 * 4/2001 Chou ..... 417/63
2002/0141890 A1 * 10/2002 Chou ..... 417/415

* cited by examiner

*Primary Examiner*—Charles G. Freay
(74) *Attorney, Agent, or Firm*—Charles E. Baxley

(57) ABSTRACT

An air compressor includes a cylinder housing having a passage formed in one end, a piston slidably received in the cylinder housing and moved relative to the cylinder housing in a reciprocating action to generate a pressurized air out through the passage of the cylinder housing. The cylinder housing includes an outlet tube having a bore communicating with the passage and the chamber of the cylinder housing, and having two or more ducts for readily coupling to and for supplying the pressurized air to the nozzle, the pressure gauge, the safety valve, or the other devices.

3 Claims, 5 Drawing Sheets

CYLINDER HOUSING FOR AIR COMPRESSOR

BACKGROUND OF THE INVENTION

1. Field of the Invention

The present invention relates to an air compressor, and more particularly to an air compressor having an improved cylinder housing for easily assembling or attaching the other parts or devices to the cylinder housing.

2. Description of the Prior Art

The present applicant has developed various kinds of typical air compressors for generating pressurized air. U.S. Pat. No. 6,200,110 B1 discloses one of the typical air compressors which includes a cylinder housing having an outlet tube.

A pipe is required to be further provided and secured or attached to the outlet tube of the cylinder housing, and a nozzle is required to be coupled to the pipe with a coupler, for allowing the air from the cylinder housing to flow to the nozzle.

The other devices or parts may not be easily secured or attached or coupled to the cylinder housing of the air compressor.

The present invention has arisen to mitigate and/or obviate the afore-described disadvantages of the conventional air compressors.

SUMMARY OF THE INVENTION

The primary objective of the present invention is to provide an air compressor including an improved cylinder housing for easily assembling or attaching the other parts or devices to the cylinder housing.

In accordance with one aspect of the invention, there is provided an air compressor comprising a cylinder housing including a chamber formed therein, and including a first end having a passage formed therein, a piston slidably received in the chamber of the cylinder housing, means for moving the piston within the chamber of the cylinder housing in a reciprocating action, and to generate a pressurized air out through the passage of the cylinder housing, the cylinder housing including an outlet tube provided on the first end thereof and having a bore formed therein and communicating with the passage and the chamber of the cylinder housing, the outlet tube of the cylinder housing including a first duct and at least one second duct extended therefrom, and a device attached to either of the first and the at least one second duct. The device may be easily and quickly or readily attached to the outlet tube of the cylinder housing via the ducts without specialized coupling members or tools.

The device may be a pressure gauge, a safety valve, a coupler, or a nozzle, or a lid selectively coupled to either of the ducts for receiving the pressurized air from the cylinder housing.

A relief valve may further be provided and attached to the outlet tube, for preventing the cylinder housing and the outlet tube from being over-pressurized.

A check valve may further be provided and disposed in the outlet tube and engaged with the passage of the cylinder housing for selectively blocking the passage of the cylinder housing.

A cap may further be provided and attached to the outlet tube for blocking the outlet tube.

The moving means includes a motor attached to the cylinder housing, a piston rod extended from the piston, and means for coupling the piston rod to the motor.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
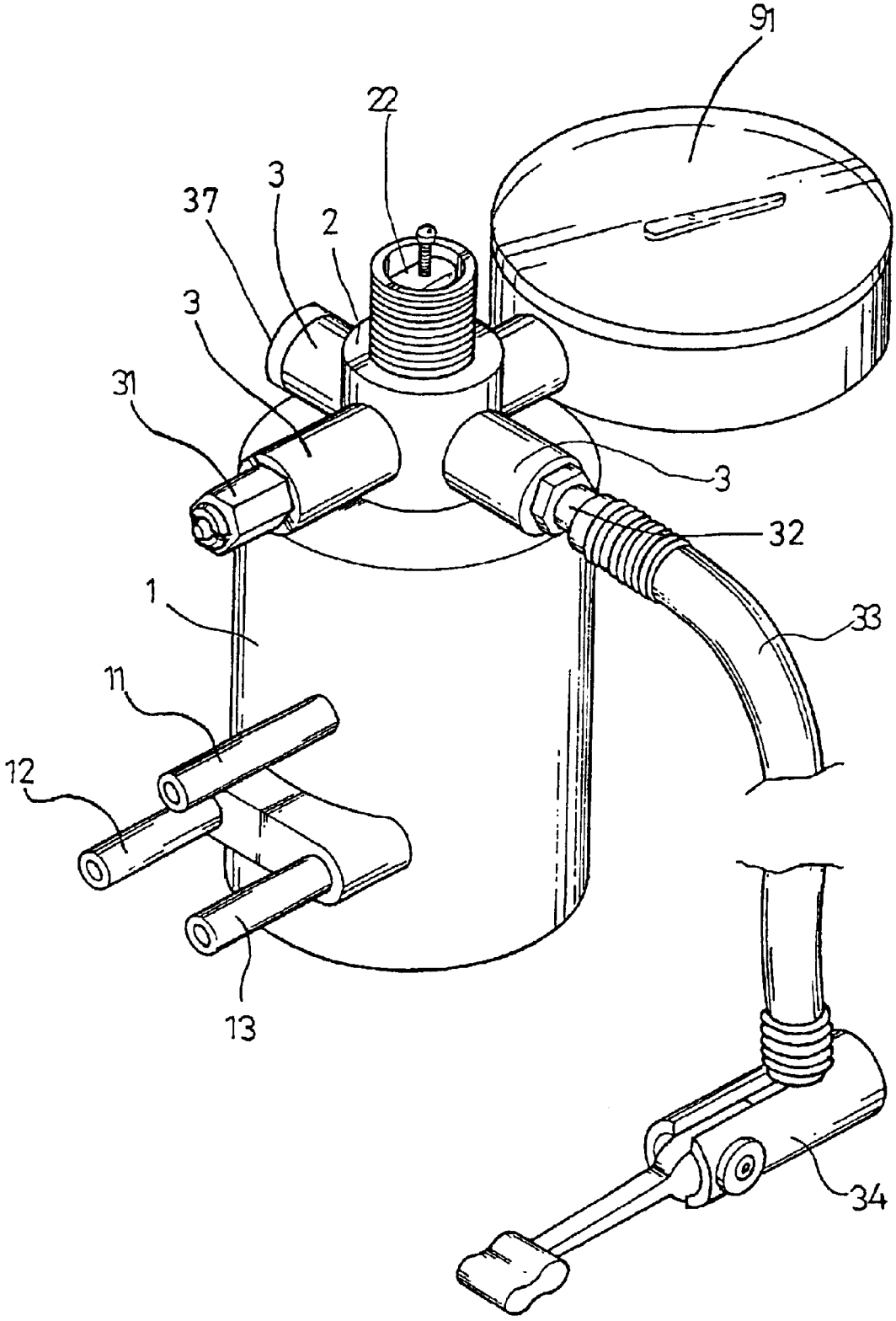
FIG. 1 is a perspective view of a cylinder housing for an air compressor in accordance with the present invention.
Figure 2:
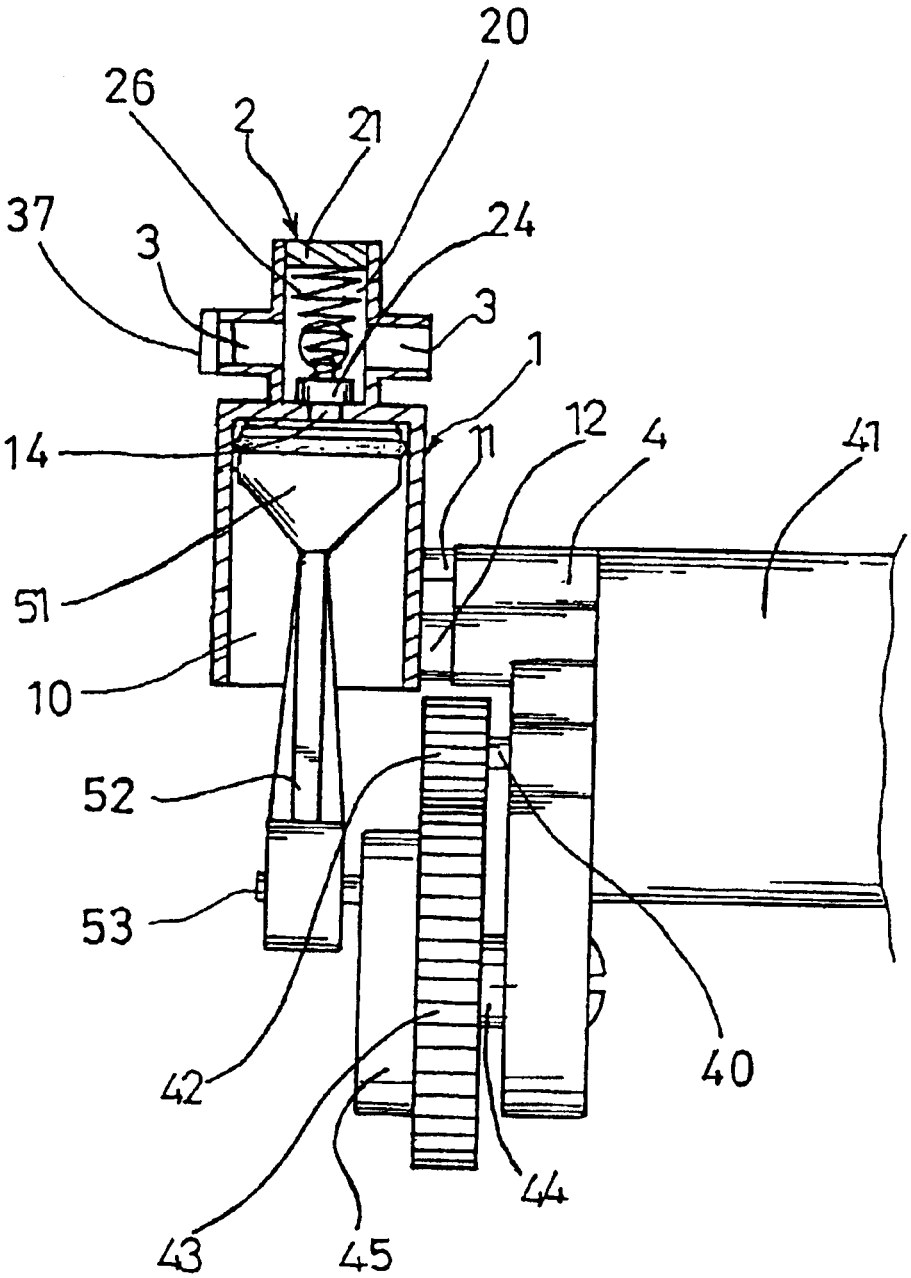
FIG. 2 is a partial cross sectional view of the air compressor.

Referring to the drawings, and initially to FIGS. 1 and 2, an air compressor in accordance with the present invention comprises a cylinder housing 1 including one or more studs 11, 12, 13 extended outwardly therefrom, such as extended laterally outwardly from the middle or lower portion thereof, and including a passage 14 formed in one end or in the upper portion thereof (FIG. 2).

As shown in FIG. 2, a plate 4 may be attached or secured onto the studs 11, 12, 13 for supporting or for securing a motor 41 to the cylinder housing 1. A gear 43 and/or a weight 45 may be rotatably secured to the plate 4 with an axle 44. A pinion 42 may be secured to a spindle 40 of the motor 41 and engaged with the gear 43, for driving the weight 45 and the gear 43.

A piston rod 52 has a piston 51 secured to one end thereof and slidably engaged in the chamber 10 of the cylinder housing 1, and includes the other end rotatably secured to the weight 45 or the gear 43 with an eccentric pin 53 which is offset from the axle 44, such that the piston 51 may be forced to move within the cylinder housing 1 in a reciprocating action by the motor 41.

In operation, when the piston 51 is driven or forced to move within the cylinder housing 1 in the reciprocating action by the motor 41, a pressurized air may be generated by the sliding and reciprocating movement of the piston 51 in the cylinder housing 1, and may be forced to flow out through the passage 14 of the cylinder housing 1. The motor 41 and the gear 43 or the weight 45 and the piston rod 52 may thus form a moving means for moving the piston 51 within the cylinder housing 1 in the reciprocating action.

Figure 5:
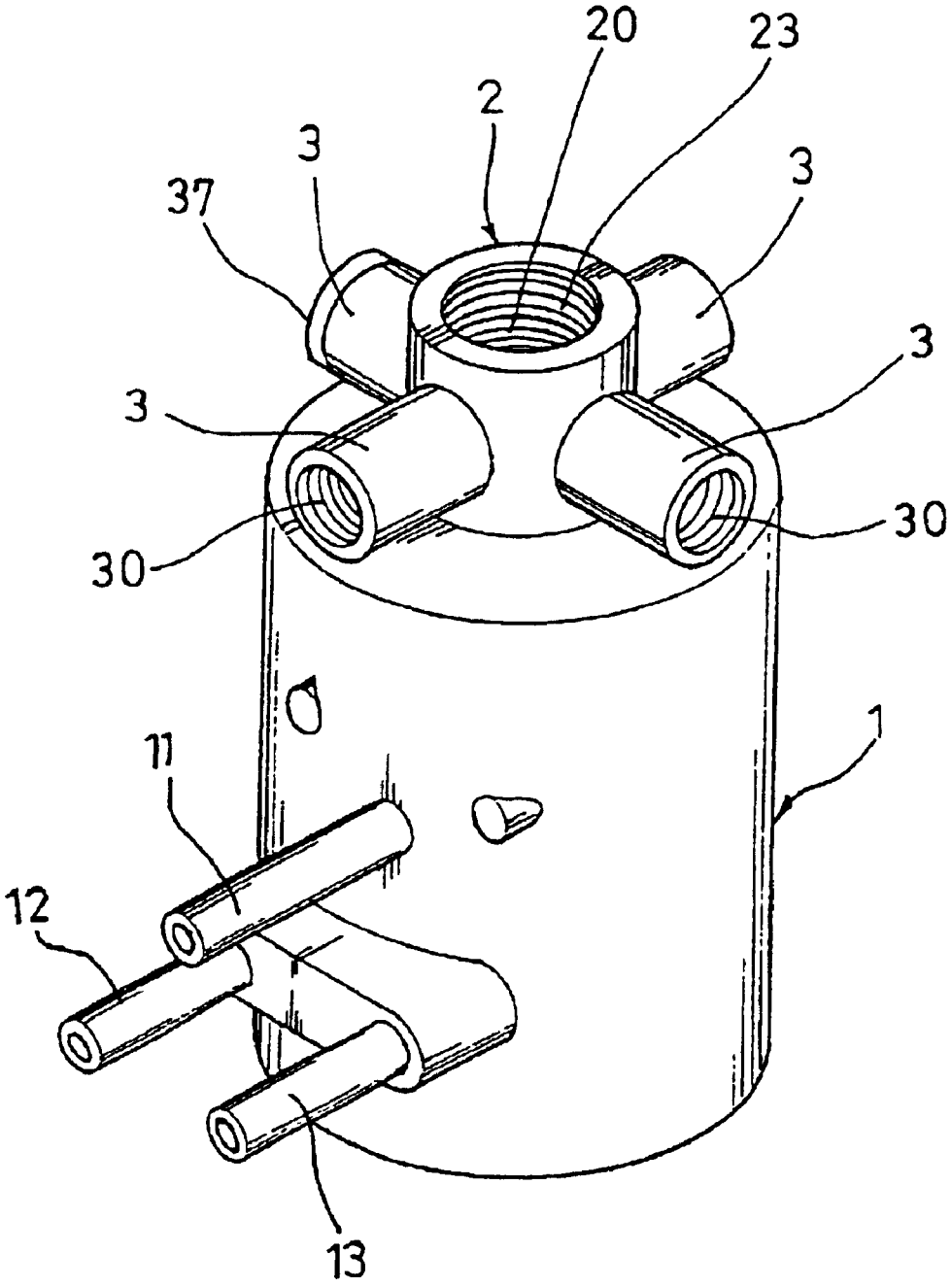

The cylinder housing 1 includes an outlet tube 2 extended or provided on top thereof and having a bore 20 formed therein (FIGS. 2, 5) and communicating with the passage 14 of the cylinder housing 1, for allowing the pressurized air generated in the cylinder housing 1 to flow into the outlet tube 2.

Figure 3:
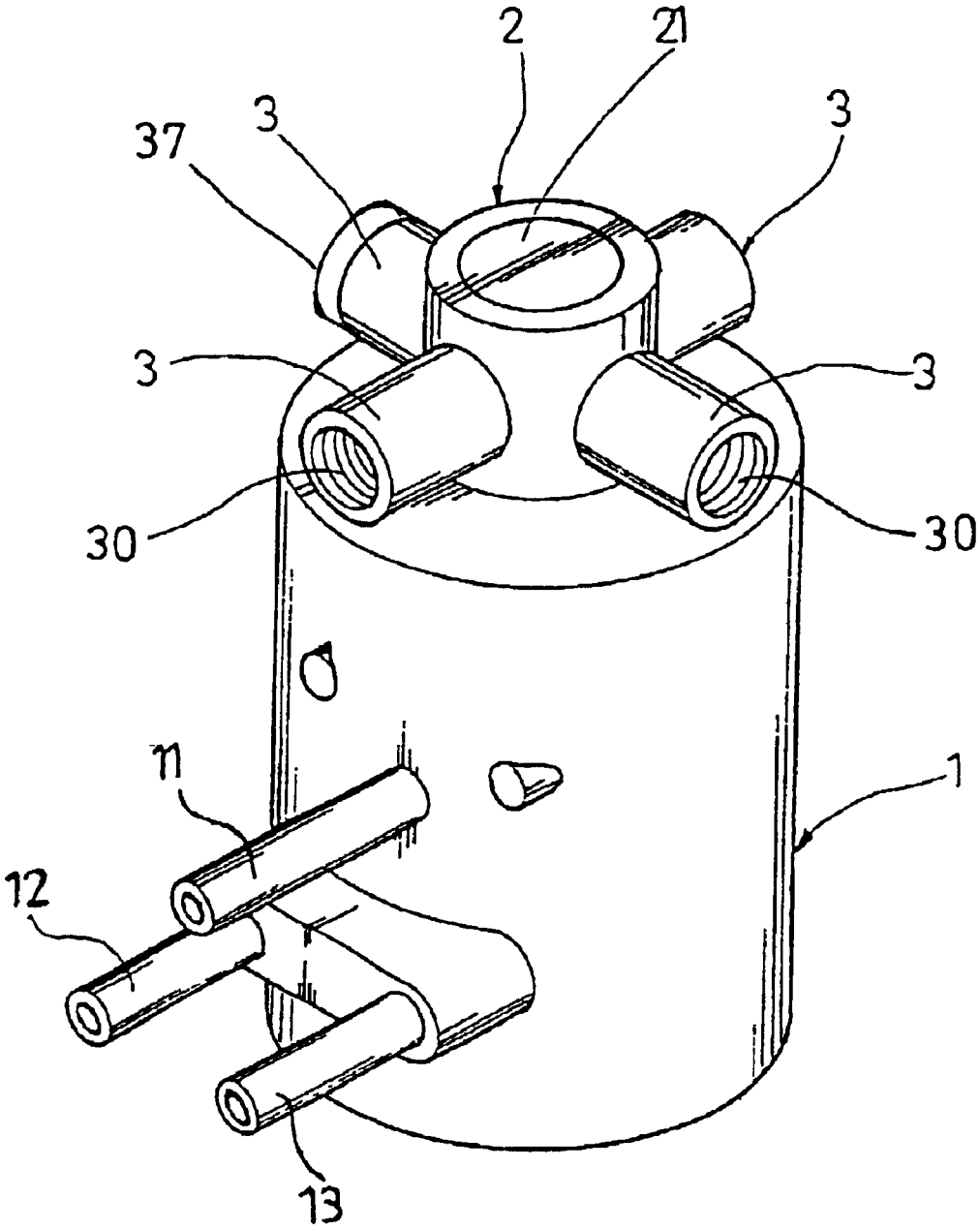
FIGS. 3, 4, 5 are perspective views similar to FIG. 1, illustrating the operation of the cylinder housing for the air compressor.

A cap 21 may be secured to the outer or free end of the outlet tube 2 (FIGS. 2, 3), for blocking or enclosing the bore 20 of the outlet tube 2. For example, the cap 21 may be threaded with an inner thread 23 of the outlet tube 2 (FIG. 5), for securing to the outlet tube 2.

As best shown in FIG. 2, a stop 24 is disposed in the outlet tube 2, and engaged onto the cylinder housing 1, for blocking the passage 14 of the cylinder housing 1. A spring 26 may be received in the outlet tube 2, and engaged with the stop 24, for biasing the stop 24 to block the passage 14 of the cylinder housing 1.

The stop 24 and the spring 26 may thus be formed as a check valve for allowing the pressurized air to flow from the cylinder housing 1 to the outlet tube 2 only, and for preventing the pressurized air from flowing backward into the cylinder housing 1.

The cylinder housing 1 further includes one or more ducts 3 extended from the outlet tube 2, and communicating with the bore 20 of the outlet tube 2, best shown in FIG. 2. The ducts 3 each preferably includes an inner thread 30 formed therein (FIGS. 3, 5) for threading with lids 37 respectively, and for blocking the ducts 3 when the ducts 3 are not required to be used.

Figure 4:
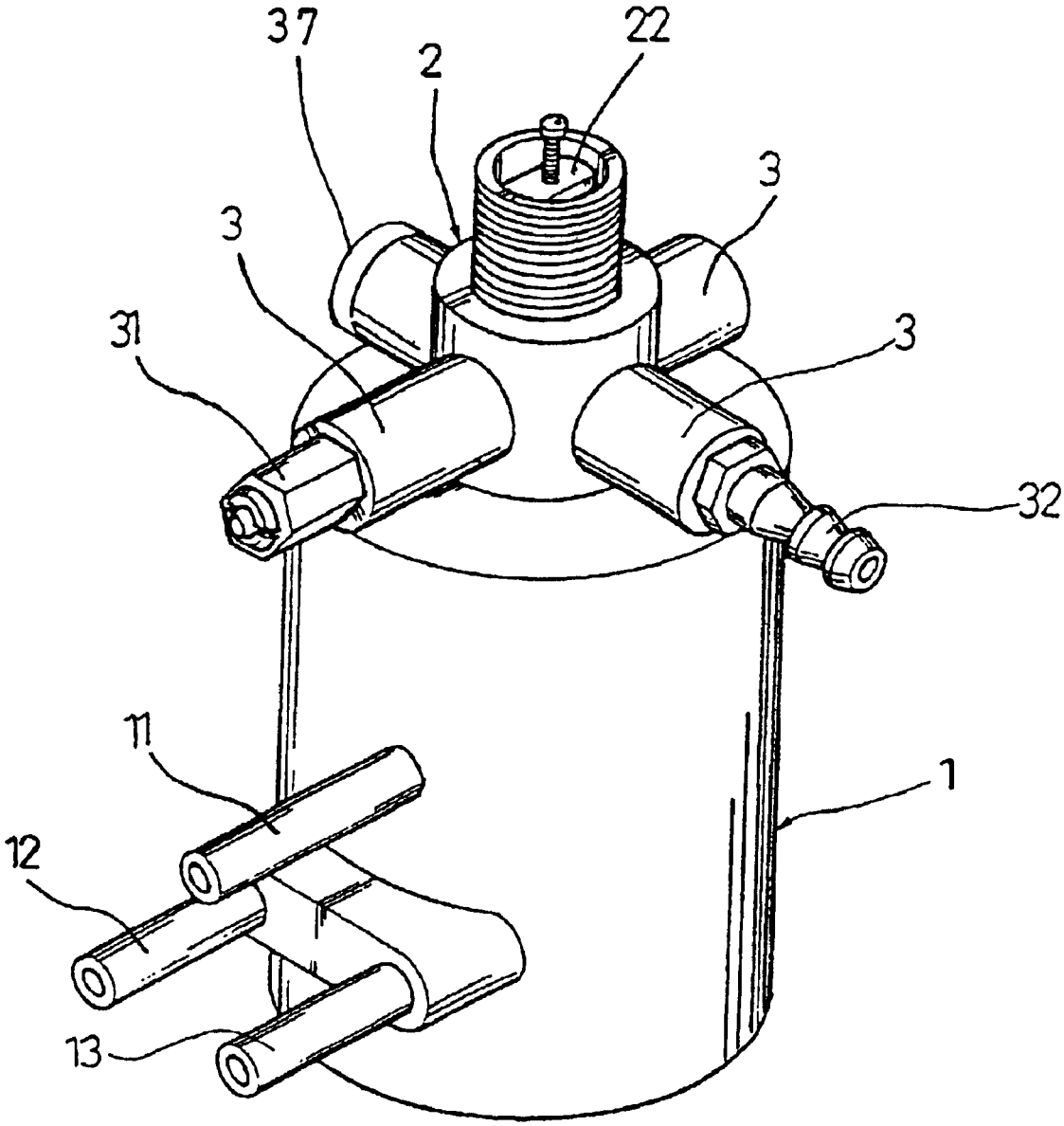

A relief valve or a safety valve 31 (FIGS. 1, 4) may be provided and attached to either of the ducts 3, for preventing the cylinder housing 1 and the outlet tube 2 from being over-pressurized. A pressure gauge 91 (FIG. 1) may be provided and attached to either of the ducts 3, for detecting or showing the air pressure within the cylinder housing 1 and/or the outlet tube 2. A coupler 32 (FIGS. 1, 4) may be provided and attached to either of the ducts 3, for coupling to a nozzle 34 with a hose 33 or the like, and for allowing the pressurized air generated in the cylinder housing 1 to flow out through the outlet tube 2, and the duct 3, and the hose 33 and the nozzle 34. The nozzle 34 may also be directly coupled to either of the ducts 3 without the coupler 32 and/or the hose 33.

A safety valve or a relief valve 22 (FIGS. 1, 4) may further be provided and attached to either of the ducts 3, or attached to the outlet tube 2, for preventing the cylinder housing 1 and the outlet tube 2 from being over-pressurized.

It is to be noted that the safety valve 31, and/or the coupler 32, and/or the pressure gauge 91 may be easily and quickly or readily attached to the upper end of the outlet tube 2 of the cylinder housing 1 directly, or attached to the outlet tube 2 indirectly via the ducts 3, without specialized coupling members or tools. The ducts 3 that are not required to be used may be blocked by the lids 37.

Accordingly, the air compressor in accordance with the present invention includes an improved cylinder housing for easily assembling or attaching the other parts or devices to the cylinder housing.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An air compressor comprising:

a cylinder housing including a chamber formed therein, and including a first end having a passage formed therein, a piston slidably received in said chamber of said cylinder housing, means for moving said piston within said chamber of said cylinder housing in a reciprocating action, and to generate a pressurized air out through said passage of said cylinder housing, said moving means including a motor attached to said cylinder housing, a piston rod extended from said piston, and means for coupling said piston rod to said motor, said cylinder housing including an outlet tube provided on said first end thereof and having a bore formed therein and communicating with said passage and said chamber of said cylinder housing, said outlet tube of said cylinder housing including a first duct, a second duct, a third duct, and at least one fourth duct extended therefrom, a coupler attached to said first duct, a hose coupled to said coupler, a nozzle coupled to said coupler via said hose, a pressure gauge attached to said second duct, a safety valve attached to said third ducts, a lid attached to said at least one fourth duct, for blocking said at least one fourth duct, a relief valve attached to said outlet tube, and a check valve disposed in said outlet tube and engaged with said passage of said cylinder housing for selectively blocking said passage of said cylinder housing.

2. The air compressor according to claim 1 further comprising a cap selectively attached to said outlet tube for blocking said outlet tube when said relief valve is removed from said outlet tube.

3. The air compressor according to claim 1 further comprising a relief valve selectively attached to said at least one fourth duct when said cap is removed from said at least one fourth duct.

* * * * *